United States Patent [19]

Allen

[11] Patent Number: 5,062,812

[45] Date of Patent: Nov. 5, 1991

[54] BATTERY CABLE CONNECTOR

[75] Inventor: William H. Allen, P.O. Box 178, Tomball, Tex. 77375

[73] Assignee: William H. Allen, Houston, Tex.

[21] Appl. No.: 601,880

[22] Filed: Oct. 22, 1990

Related U.S. Application Data

[63] Continuation of Ser. No. 501,012, Mar. 29, 1990, abandoned.

[51] Int. Cl.[5] ..... H01R 11/01

[52] U.S. Cl. ..... 439/756

[58] Field of Search ..... 439/756–758, 439/762, 764–766, 771

[56] References Cited

FOREIGN PATENT DOCUMENTS 0918538 2/1947 France ..... 439/756

0925616 9/1947 France ..... 439/756

*Primary Examiner*—Paula A. Bradley

*Attorney, Agent, or Firm*—Vaden, Eickenroht, Thompson & Boulware

[57] ABSTRACT

There is disclosed a connector for electrically connecting the bared ends of one or more battery cables to a post of a storage battery by holding the cable ends are held in direct contact with the post.

6 Claims, 1 Drawing Sheet

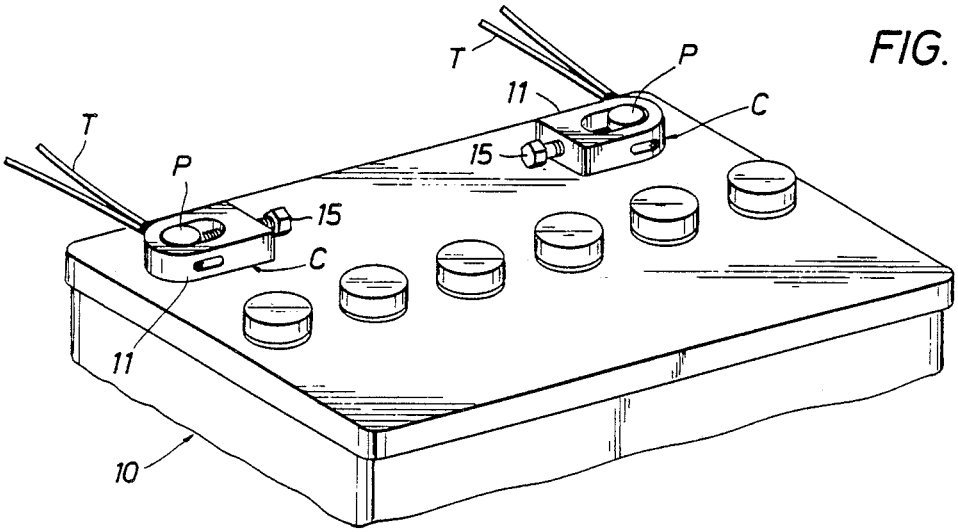
FIG. 1
FIG. 2
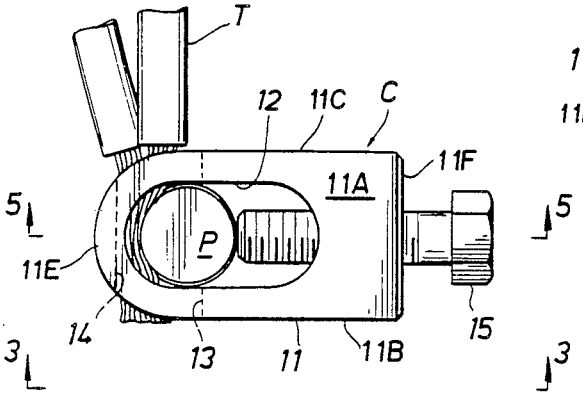
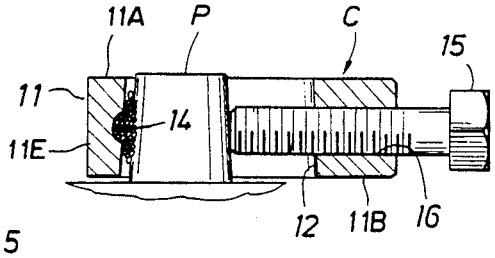
FIG. 5
FIG. 3
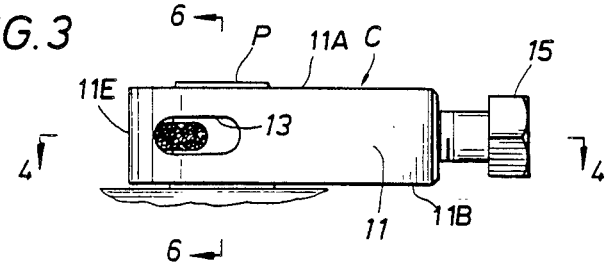
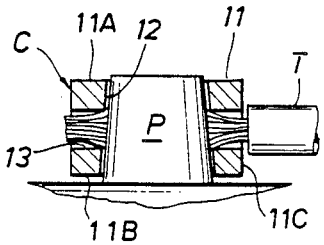
FIG. 6
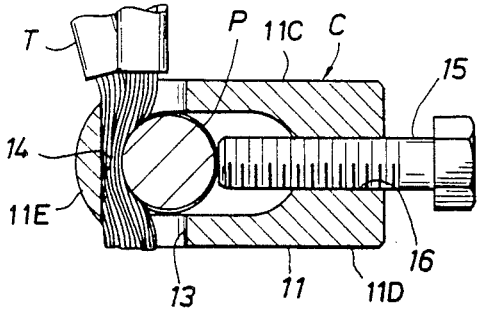
FIG. 4

BATTERY CABLE CONNECTOR

This application is a continuation of my copending application, Ser. No. 07/501,012, filed Mar. 29, 1990, and entitled "Battery Cable Connector" now abandoned.

This invention relates generally to a connector for electrically connecting the bared end of one or more battery cables to a terminal post of a storage battery. More particularly, it relates to an improved connector of this type in which the bared end of the cable is held in electrical contact with the post.

A connector of this type in common use with automobile batteries comprises a generally "C" shaped body having arcuate inner surfaces adapted to fit over the post and adapted to be tightly clamped about the post by means of a bolt threadedly connecting the free ends of the arms of the body and a hole in the opposite end of the body in which the bared end of the cable is anchored. The body of the connector is made of lead in order to conduct current between the end of the cable and the post.

The arcuate surfaces of the "C" shaped body quickly corrode due to arcing between them and the post, thus requiring their frequent replacement. Corrosion often also extends to the threads of the bolt making it difficult to remove the connector from the post. Even when the connector is removed, the post must be cleaned before reconnection of the cable.

Original connectors of this type are usually replaced with connectors which comprise similar "C" shaped bodies, but in which a bared end of the cable is received within a slot formed between a groove in the end of the body and a retainer plate bolted across the groove. Thus, in replacing the original connector, the cable must be cut from its body and a new end bared for insertion into the slot in the body of the replacement connector. Although the plate may be tightened against the body, it is difficult to obtain good electrical connection between the cable and body, particularly when the slot is to receive the ends of two cables, as is conventionally required in the case of new automobiles.

U.S. Pat. Nos. 4,294,505 and 4,372,636 show other connectors in which the bared end of each cable is held in direct electrical contact with the post, such that the body may be formed of plastic or other non-electrically conductive material. More particularly, the connector comprises a body having a slot to fit over the post, a bolt threadedly connected to a hole in one end of the body and an opening in the side of the body which intersects the slot at its end adjacent the bolt, so that the bared end of each cable may be moved through the opening into a position between a side of the post and the end of the bolt. Thus, the bolt may be moved inwardly to engage and tightly compress the ends of the cables against the side of the post.

It is understandable, however, that connectors of this latter type have apparently not been commercialized. For one thing, the end of the bolt would tend to spread the wires of the bared end of the cable and thus hold only a limited number of them in electrical contact between the post and end of the bolt. Also, the threads on the bolt are in such position as to be susceptible to corrosion due to arcing across the post and bared end of the cable. Still further, the connector may have a tendency to slip off of the post during use.

French Patent No. 925,616 shows a connector similar to those of the above noted U.S. patents, but differing in that the side opening in the body intersects the end of the slot opposite that in which the bolt is received. Thus, as the bolt is moved inwardly to engage one side of the post, and thus move the other side of the post and the opposite end of the slot toward one another, the bared end of the cable is compressed between them. Although this might overcome certain of the problems noted above with respect to the connector of U.S. Pat. Nos. 4,294,505 and 4,372,636, it nevertheless would create other problems which presumably have also discouraged its commercialization.

For one thing, the end of the body through which the bolt is received has a boss or collar which creates weak areas at its intersection with the wider end of the main portion of the body in which the slot is formed. Consequently, these necked down parts of the body may break when the end of the bolt is moved against the side of the post of the battery with sufficient force to compress the bared end of the terminal sufficiently tightly against the end of the slot o prevent arcing. In addition, of course, the overall body including the boss is of a shape which is difficult to fabricate, particularly by casting.

In addition, an arcuate plate is mounted on the inner end of the bolt for engaging the side of the post as the bolt is moved inwardly. Thus, the inner end of the bolt is riveted to a hole in the plate to mount the plate in a position to engage the post. This not only increases the cost of manufacturing the connector, but also requires a time consuming assembly procedure since the plate must be held in the slot as it is connected to the end of the bolt.

In an apparent attempt to improve the electrical contact between the bared end of the cable and the end of the slot, as the plate on the bolt is moved against the post, the side opening in the body forms an arcuate groove in the slot intermediate its upper and lower ends in which a portion of the bared end of a cable is adapted to be received. However, the groove is of substantial depth equal to at least one half the length of the side opening. As a result, if the bared end of the cable is relatively small, the post and end of the slot may engage, as the bolt is moved inwardly, to prevent the bared end from being compressed sufficiently tightly between the opposite side of the post and the groove to avoid arcing between them.

Also, the curved surface at the end of the slot in which the groove is formed is of such shape as to subtend only a relatively small angle. As a result, the portion of the bared end of the cable which is compressed between the post and end of the slot may be so limited as to cause arcing. Still further, due to the length of the side opening, and the limited travel of the bolt in the slot, difficulty may be encountered in installing the bared end of an oversized cable or the bared ends of two cables, as one often uses with batteries for many modern-day vehicles.

It is therefore an object of this invention to provide a connector which overcomes one or more of the shortcomings of these prior connectors, and particularly that last described, in that it is made up of a minimum number of easily fabricated and assembled parts and further in that the bared end of a cable or the bared ends of more than one cable may be easily installed in the connector and tightly compressed with less likelihood of arcing and thus possible corrosion.

These and other objects are accomplished, in accordance with the illustrated embodiment of the invention by the provision of a connector, which, as in the case of the above described connector, comprises a body having an elongate slot of a width to fit over the terminal post, and an opening in the side of the body intersecting one end of the slot to permit the bared end of each of one or more cables to be inserted into the opening for disposal between said one end of the slot and one side of the post. More particularly, a bolt is threadedly received through a hole in the opposite end of the body for movement against the opposite side of the post so as to compress the end of the cable between the one end of the slot and said one side of the post. Since the bared end of the cable is not engaged by the end of the bolt, it does not tend to be spread out of contact with the post, but instead is compressed across its entire width between the post and the end of the slot in the body. In fact, it is anticipated that the wires of the end of the cable will actually dig into not only the side of the post, but also the end of the slot to form lateral serrations which positively resist any tendency for the connector to slip off of the post.

Since it need not be electrically conductive, the body may be molded of plastic material. Preferably, however, it is cast of metal, such as brass or bronze, although the shape and construction of the body which makes it easy to die cast may dictate the use of zinc due to its low cost and particular adaptability to die casting.

In accordance with one novel aspect of this invention, the connector need comprise only two parts, namely, a body of such construction as to permit it to be inexpensively fabricated and a bolt of such construction that it may be purchased as an off-the-shelf item, both of which may be assembled, and disassembled for repair, if required, with a minimum of time and effort. Thus, as compared with the complex body shape of the connector of French Patent No. 925,616, the body has substantially flat, parallel top and bottom walls, substantially flat, parallel side walls, and end walls extending between the opposite ends of the top, bottom, and side walls, and an elongate slot which connects its top and bottom walls for fitting over the post. Since the body has no protruding parts, it is easily fabricated, preferably by die casting. More particularly, due to the shape of the body, the forces which are imposed on its side portions, as the bolt is forced against the post, are carried in tension. For this purpose, the sides of the slot formed in the body are essentially symmetrical of the sides of the body so that both side portions of the body carry equal tension loads.

More particularly, the inner end of the bolt in engagable with the side of the post, as the bolt is moved inwardly, and it is not necessary to provide additional specially fabricated parts to be assembled on the end of the bolt for engaging the post. Thus, upon casting of the body, and machining of a threaded hole therein to receive the bolt, the connector is prepared for assembly at the point of manufacture, or in the field, if necessary. Furthermore, the bolt need only be backed out of the threaded hole in order to remove the connector from the post.

In accordance with another novel aspect of the invention, the surface of the side opening in the connector body at its intersection with the end of the slot and against which the end of the cable is compressed is substantially flush with the surfaces of the one, end, of the slot toward which the side of the post is moved, as the bolt is moved inwardly. Thus, substantially the entire thickness of the bared end of the cable is subjected to compression between the surface and side of the bolt to insure optimum electrical contact regardless of the size of the cable.

In the preferred embodiment of the invention, the side opening forms a groove in the surface of the end of the slot against which the bared end of the cable is compressed, which has been found to assist in maintaining the bared end of the cable in place and thus preventing the connector body from moving off the post. However, as compared with the connector of French Patent No. 925,6I6, the groove is of shallow depth only a relatively small fraction of the length of the opening, thus leaving substantially all of the bared end of the cable in position to be compressed between the side of the post and the end of the slot. More particularly, the end of the slot intersected by the side opening is curved about an arc which subtends an angle of 180° so as to insure that the side of the post engages a maximum portion of the bared end of the cable.

As illustrated, the side opening in the body is at least twice as long as it is wide, and the slot in the connector body is of a length approximately twice the width of the post, so that the bared end of a large cable or the bared ends of more than one cable may be easily installed between the end of the slot and inner end of the bolt.

In the drawings, wherein like reference characters are used throughout to indicate like parts:

FIG. 1 is a perspective view of the top of a storage battery having a pair of posts to which terminal cables are connected by connectors constructed in accordance with the present invention;

FIG. 2 is a top plan view of one of the connectors with the bared ends of a pair of the terminal cables held in tight engagement between a post of the battery and the end of a slot in the connector body disposed over the post;

FIG. 3 is a side elevational view of the connector and ends of the terminal cables and post, as seen along broken lines 3—3 of FIG. 2;

FIG. 4 is a horizontal sectional view of the connector, post and bared ends of the cables, as seen along broken lines 4—4 of FIG. 3.

FIG. 5 is a vertical sectional view through the connector, post and ends of the cable, as seen along broken lines 5—5 of FIG. 2; and FIG. 6 is another vertical sectional view of the post ends of the cables and connector body, as seen along broken lines 6—6 of FIG. 3.

With reference now to the details of the above described drawings, the storage battery shown in FIG. 1 and indicated in its entirety by reference character 10, has the usual cells for receiving battery fluid as well as a pair of posts P upstanding from the top of the battery in spaced apart relation. As well known in the art, the posts provide the means by which the battery is electrically connected to various parts of the automobile by means of terminal cables electrically connected between them. As shown, and as is conventional with new automobiles, a pair of such cables T are electrically connected to each such post, one pair, for example, leading from the starter of the automobile engine and to a ground of the engine block, and the other pair leading to the alternator (or generator) and a ground. Although the connectors to be described are particularly well suited for use in electrically connecting two or more such cables to a post, it should be understood that only one such cable may be so connected.

In any case, and as shown in FIGS. 2 to 6, the wires at the ends of the terminal cables T are bared by stripping of the insulating cover therefrom. As also shown in FIGS. 1, 5 and 6, the posts are tapered upwardly at a small angle with respect to the vertical.

Each connector, which is indicated in its entirety by the letter C, comprises a body having substantially flat, parallel top and bottom walls 11A and 11B, substantially flat, parallel side walls 11C and 11D, and end walls 11E and 11F extending between the opposite ends of the top, bottom and side walls. Thus, the body is essentially rectangular as viewed from its sides and ends as well as from the top and bottom, except for the curved left end wall, which, however, may also be substantially flat and parallel to the right end wall.

The body also has a slot 12 which extends therethrough to connect the top and bottom walls 11A and 11B, and which is of a width to permit it to be disposed over a post P, as shown in the drawings, and of a length approximately twice the width of the post. As shown, the sides of the slot 12 are tapered upwardly at a small angle corresponding to the taper of the sides of the posts so as to fit closely with respect to the sides of the posts. As also shown, the ends of the slot are curved about an arc subtending 180°, and, like the sides of the slot, tapered at a small angle with respect to the vertical, so that, as shown, one end of the slot may be moved to a position close to one side of the post.

As also shown, a side opening 13 is formed through the body to connect its side walls and intersect the end of the slot adjacent the post, whereby the bared ends of the cables T may be extended therethrough into positions between the end of the slot and the adjacent side of the post. As previously mentioned, the opening is at least twice as long as it is wide. More particularly, one end of the opening forms an arcuate groove 14 in the end of the slot so as to receive a small portion of the bared ends of the cables installed between the end of the slot and the adjacent side of the post.

A bolt 15 is threadedly mounted in a hole 16 connecting the opposite end of the slot with the right end 11F of the body so as to permit the inner end of the bolt to be moved toward and away from the side of the post P opposite that which is engaged with the bared ends of the cables. Thus, as the bolt is moved inwardly to the position shown in the drawings, it will force the side of the post opposite the bolt tightly against the bared ends of the cables so as to tightly compress the bared ends of the cables and thus establish electrical contact between the ends of the cable and the post.

More particularly, the bolt will compress a portion of the wires at the bared ends of the cables against into the arcuate surface provided by the groove 14 and compress the remainder thereof between the side of the post and the adjacent surface of the slot above and below the groove, as shown in FIG. 5. It is contemplated that this tight engagement between the wires, post and cable will cause the wires to bite into and form serrations in the surfaces of the post and end of the slot in the body, thereby forming a tight grip between the connector and post. At the same time, the groove is sufficiently shallow that, as shown in FIG. 2, the bared ends of the cables are tightly compressed before the side of the post engages the end surfaces of the slot above and below the groove.

As previously indicated, since the bolt is on the side of the post opposite that engaged with the bared ends of the cables, there is less tendency for arcing between the posts and cables to cause corrosion of the threads of the bolt. This of course not only extends the usable life of the connector, but also enables the bolt to be backed off, if required, to permit replacement or reconnection of a connector.

As also previously indicated, the connector body may be made of brass or bronze, or preferably zinc, and, in any event, is of such configuration that it may be easily die cast, thereby facilitating its manufacture. Alternatively, of course, since the cable ends and posts are in direct electrical contact, the body 11 of the connector could be formed of plastic or other non-electrically conductive material. In any case, the connector is of extremely simple construction in that it requires only one additional part, the bolt 15, which may be of standard commercially available construction.

As previously mentioned, the use of a standard bolt also facilitates assembly and disassembly of the connector, and enables its inner end to be withdrawn to a position in which the ends of even larger cables may be installed through the side opening. For this purpose, the slot is approximately twice as long as it is wide. Obviously, the slot and opening may both be made even longer relative to their widths so as to extend for much of the entire length of the body.

As shown in FIG. 1, the connectors may be arranged in opposed relation to one another. Alternatively, their positions may be reversed such that their bolts extent away from one another, or in positions to dispose the connectors parallel to one another. It will be further obvious that the bodies of the connectors are of such shape as to permit the jaws of jumper cables to be easily connected to and disconnected therefrom.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A connector for electrically connecting the bared end of one or more battery cables to a terminal post of a storage battery, comprising a body having top and bottom walls, side walls, and end walls, an elongate slot in the bottom wall of a width to fit over the terminal post, an opening connecting the side walls and intersecting one end of the slot near one end wall of the body to permit the bared end of each such cable to be inserted into the opening for disposal between said one end of the slot and one side of the post, and a threaded hole connecting the other end wall and other end of the slot, and a bolt threadedly received within the hole for inward and outward movement toward and away from the one end of the slot so as to permit its inner end to tightly engage with the other side of the post, when moved inwardly, so as to compress the bared ends of the cable between said one end of the slot and one side of the post, said inner end of the bolt being of a size for passing into and out of the threaded hole.

2. A connector of the character described in claim 1, wherein, the distance between the side walls of the body between the inner and outer ends of the threaded hole are essentially equal.

3. A connector for electrically connecting the bared end of one or more battery cables to a terminal post of a storage battery, comprising a body having an elongate slot of a width to fit over the terminal post and an elongate opening in the body intersecting one end of the slot to permit the bared end of each such cable to be inserted into the opening for disposal between said one side of the post and an arcuate end surface of the opening which is substantially flush with arcuate surfaces of said one end of the slot on opposite sides of said arcuate surface of the opening, and a bolt threadedly received through a hole in the opposite end of the body to permit it to be moved inwardly so as to compress the end of the cable between said one side of the post and said arcuate surface of the opening.

4. A connector of the character described in claim 3, wherein said surfaces of the slot on opposite sides of the groove subtending an angle of 180°.

5. A connector of the character described in claim 3, wherein, the distance between the side walls of the body between the inner and outer ends of the threaded hole are essentially equal.

6. A connector for electrically connecting the bared end of one or more battery cables to a terminal post of a storage battery, comprising a body having top and bottom walls, side walls, and end walls extending between the opposite ends of the top, bottom, and side walls, an elongate slot connecting with the bottom wall of a width to fit over the terminal post, an opening connecting the side walls and intersecting one end of the slot near one end wall of the body to permit the bared end of each such cables to be inserted into the opening for disposal between said one end of the slot and one side of the post, and a threaded hole connecting the other end wall and other end of the slot, and a bolt threadedly received within the hole for inward and outward movement toward and away from the one end of the slot so as to tightly engage the other side of the post, when moved inwardly, so as to compress the bared end of each such cable between said one end of the slot and one side of the post, this distance between the side walls of the body between the inner and outer ends of the threaded hole being essentially equal.

* * * * *